United States Patent [19]

Peters

[11] 3,987,948

[45] Oct. 26, 1976

[54] APPARATUS FOR OPENING DRUPACEOUS FRUIT

[76] Inventor: Lester Grant Peters, P.O. Box 407, Newburyport, Mass. 01950

[22] Filed: May 19, 1975

[21] Appl. No.: 578,882

Related U.S. Application Data

[63] Continuation-in-part of Ser. No. 464,703, June 20, 1974, abandoned, which is a continuation-in-part of Ser. No. 320,458, June 2, 1973, abandoned.

[52] U.S. Cl. ..... 225/97; 99/555; 99/563; 225/103; 426/485

[51] Int. Cl.[2] ..... B26F 3/00

[58] Field of Search ..... 225/93, 97, 103, 104; 83/2, 4; 99/537, 552, 555–556, 562–563; 426/484–485

[56] References Cited

UNITED STATES PATENTS

| | | | |
|---|---|---|---|
| 2,403,517 | 7/1946 | Gaddini | 426/485 |
| 2,403,518 | 7/1946 | Gaddini | 99/555 |
| 2,840,129 | 6/1958 | Jovis | 225/93 X |

*Primary Examiner*—Othell M. Simpson
*Assistant Examiner*—Fred A. Silverberg
*Attorney, Agent, or Firm*—Lee A. Strimbeck

[57] ABSTRACT

A single-stone containing fruit of the drupe family is laid open to permit removal of the stone and implanting of a filling, if desired, by centrally impaling it on a row of tines, every other one of which is held on one half of a split platform with the remainder being held on the mating other half of the platform such that when the split platform is forceably opened the fruit is torn open exposing the stone. The row of tines has tines of lesser length in mid-portion to accommodate the stone and an overhead moveable bar carries a mating row of tines that pierce the fruit above the stone. This bar can be carried on a strike arm adapted to engage a strike plate on one of the platform halves and force the platform to open when the bar is forced downwardly as by being struck smartly with the hand.

3 Claims, 4 Drawing Figures

APPARATUS FOR OPENING DRUPACEOUS FRUIT

RELATED APPLICATION

This application is a continuation-in-part of an earlier co-pending application by the same inventor, "Process for Making Filled Fruit," Ser. No. 464,703, filed June 20, 1974, and now abandoned, which in turn was a continuation-in-part of "Process of Making Filled Fruit," Ser. No. 320,458, filed Jan. 2, 1973, and now abandoned.

THIS INVENTION

This invention is concerned with apparatus for laying open single stone fruits of the drupe family such as peaches and plums. In brief compass a drupe is opened by impaling it on a row of closely spaced tines or spears that fit around the stone of the fruit. Every other tine in the row is held on a moveable section of a platform, with the other half of the tines being held on a mating fixed section of the platform. When the two sections of platform are moved apart, the impaled fruit is torn open exposing the stone which then may be removed if it has not already dropped out.

In a preferred embodiment a moveable bar over the row of tines holds a complementary second row of tines that are adapted when the bar is moved towards the first row of tines to pierce and hold the fruit in the area of the stone on the other side from the first row. The means for opening the two sections of the platform can be associated with the bar such that when it is moved towards the fruit impaled on the first row of tines the sections are forced open during the latter stage of the motion of the bar.

DRAWINGS

DESCRIPTION

With reference to the drawings, the apparatus comprises a platform 10 having mating halves 10*a* and 10*b*. Section 10*a* is affixed to a suitable supporting surface such as a table top 11 by screws 12.

Figure 1:
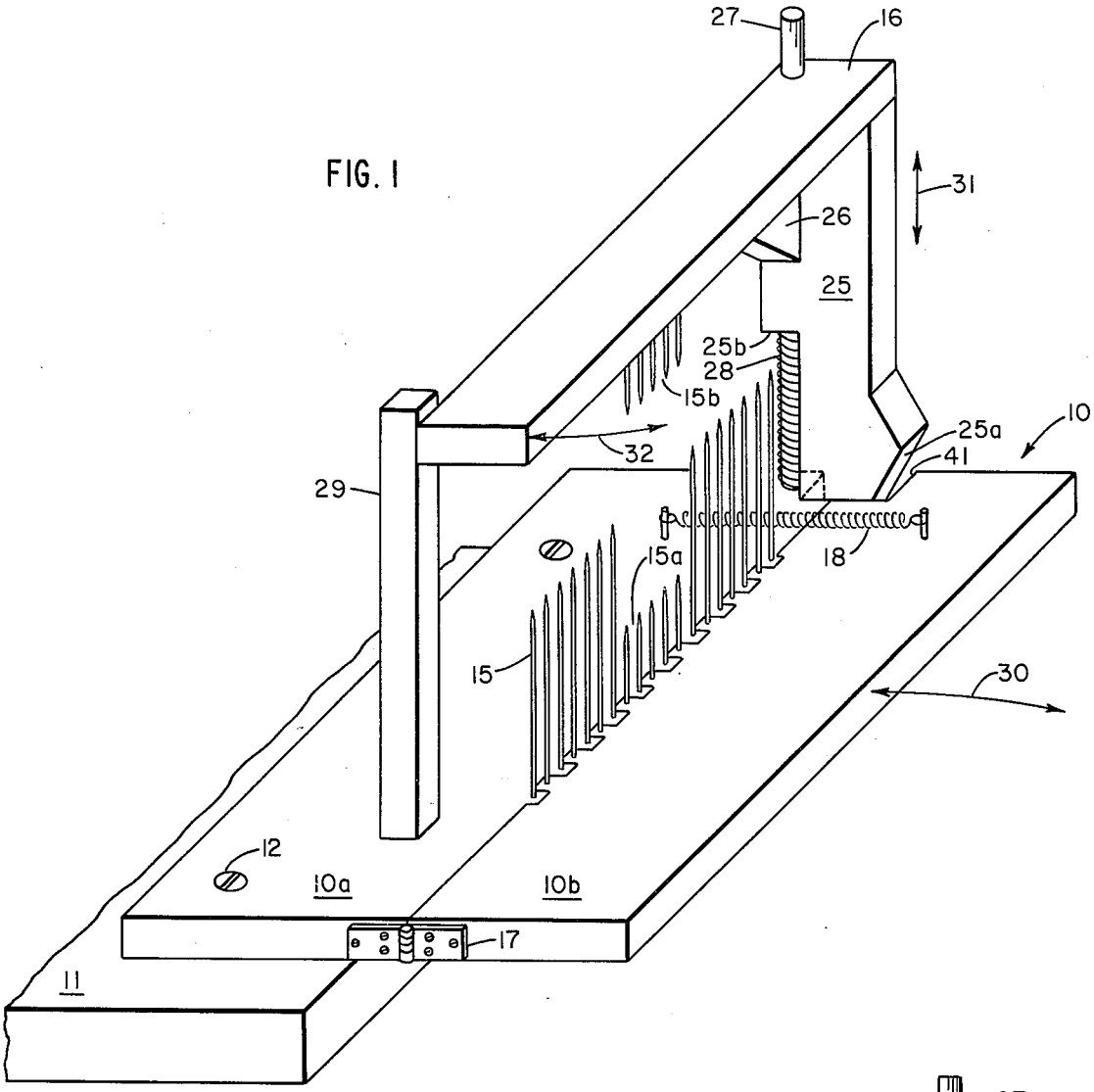
FIG. 1 is a prospective view of one form of the apparatus of this invention.
Figure 2:
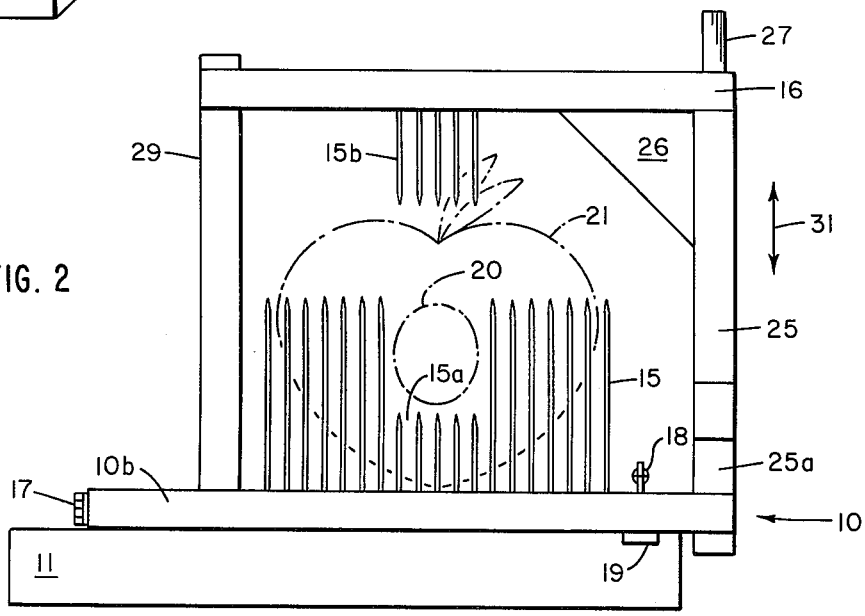
FIG. 2 is a side-elevation view of the same apparatus.
Figure 3:
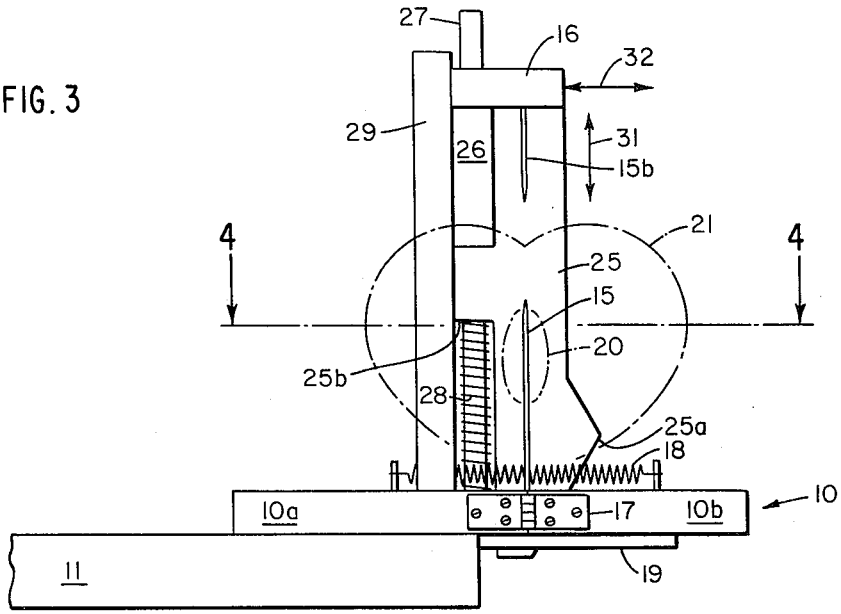
FIG. 3 is a front-elevation view.
Figure 4:
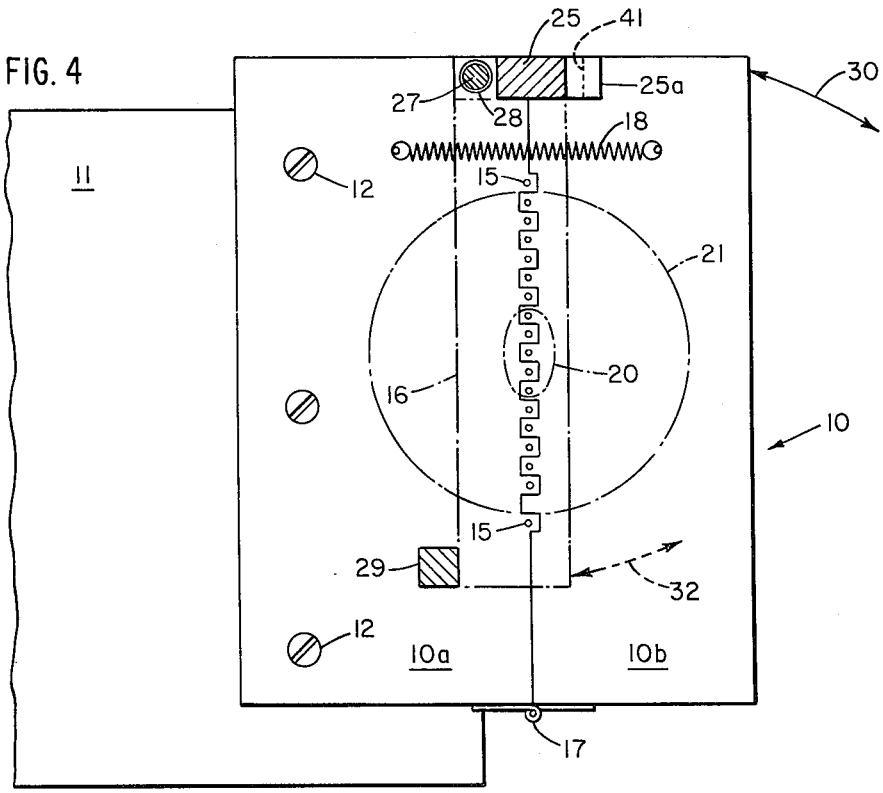
FIG. 4 is a top view taken along the line A—A in FIG. 3.

A row of tines 15 is supported by platform 10, approximately every other one of which is held by the moveable section 10*b* with the remainder being held by the fixed section 10*a*, the line of mating between the two being in an interlocking square or saw toothed pattern, as best seen from FIG. 4, in order to accomplish this. The mid portion 15*a* of the row of tines has tines that are shorter so that the tines will fit about the stone 20 of a fruit 21, both of which are shown in shadow outline, impaled thereon. A short second row of tines 15*b* held by a bar 16 above the first row complement tines 15*a* and are adapted wnen bar 16 is lowered to engage or pierce the fruit 21 above its stone 20. All of the tines can be made height adjustable, of course, as by having them extend through their holding members and threadably engage adjusting and locking nuts on the reverse side (not illustrated). In this manner the free space created by lowered tines 15*a* can be adjusted to accommodate drupes of different types and/or fruits or varying varieties and sizes.

Split platform 10 is pivotedly held together at one end of the row of tines 15 as by a hinge 17. A spring 18 or like means can be used to bias the sections 10*a* and 10*b* in the closed position while permitting them to swing open as shown by direction arrow 30. Half 10*b* can be supported against dropping as it opens by a support bar 19 over which it can slide, support bar 19 being affixed only at the end engaging section 10*a* as by screws (not shown).

Upper bar 16 is supported by a striker arm 25 which has a striker face 25*a*. Elements 16 and 25 can be held together by screws and braced with a diagonal brace 26. Bar 16 is shown only in shadow outline in FIG. 4. Striker arm 25 is mounted for rotation and for up and down motion to fixed platform section 10*a* via a rigid post or rod 27 which fits within a bore in the striker arm. A portion of the striker arm 25 is recessed at 25*b* to expose rod 27 and permit a spring 28 to be held in the recess which spring serves to return bar 16 to its normally open or up position. As can be seen the mounting of striker arm 25 in this manner on post 22 permits it and bar 16 to move up and down as shown by direction arrow 31 and to rotate out of position as shown by direction arrow 32. A stop 29 is positioned on fixed platform section 10*a* to help position bar 16.

The end of platform section 10*b* to swing open has a striker 41, the surface of which is adapted to engage striker face 25*a* when it is in the lowered position during the latter stage of the downward movement of bar 16. As striker face 25*a* engages striker 41 it wedges it open and if done smartly enough as by striking bar 16 with the hand it can be made to "fly" open against the action of spring 18. Spring 18 serves to close sections 10*a* and 10*b* after striker arm 25 is returned to its original up position by the action of spring 28.

In operation the fruit 21 is first prepared by removing its skin by peeling by hand, with a lye treatment or the like. Arm 16 is swung aside and the fruit 21 is pushed into or impaled on tines 15 with the stone being centered, approximately, in the free space between tines 15*a* and 15*b*. Bar 16 is then rotated into position against stop 26 and urged downwardly such that tines 15*b* commence to pierce fruit 21. At about this point and as bar 16 along with striker arm 25 continue their downward course, striker face 25*a* engages striker 41 wedging the two platform sections 10*a* and 10*b* apart and causing the tines 15 to separate and tear the impaled fruit in half. This exposes the stone 20 which can then be picked out if it has not already fallen out. The fruit sections are then removed and spring 28 returns bar 16 to its original up position and spring 18 closes sections 10*a* and 10*b* in preparation for the next fruit.

What is claimed is:

1. Apparatus for opening a drupe having a stone, comprising a. a working platform supporting a first row of tines, said platform being split along the line of said tines into right and left sections so mating that approximately every other of said tines are supported by one of said sections and the balance by the other section, said sections being pivotedly connected at one end of said first row of tines, b. said first row of tines supported by said sections having a central portion of which is of lesser length than on either end leaving thereby a free space in said row to accommodate said stone, c. a bar spaced from said row of tines and in line therewith, said bar having a second row of tines complementary and in opposition to said free space, said bar being capable of moving towards and away from said first row of tines, and d. first means for placing said bar in a position close to said first row of tines with said second row of tines in position to pierce said drupe impaled on said first row of tines with said stone thereof approximately centered in said free space, and second means for forceably opening said right and left sections about the pivot point of said one end to thereby tear open any drupe so impaled on said first row of tines.

2. Apparatus for opening a drupe having a stone, comprising a. a working platform supporting a first row of tines, said platform being split along the line of said tines into right and left sections so mating that approximately every other of said tines are supported by one of said sections and the balance by the other section, said sections being pivotedly connected at a pivot point at one end of said first row of tines, b. said first row of tines supported by said sections having a central portion of which is of lesser length than on either end leaving thereby a free space in said row to accommodate said stone, c. a bar spaced from said row of tines and in line therewith, said bar having a second row of tines complementary and in opposition to said free space, said bar being capable of moving towards and away from said first row of tines, and d. a striker slideably supported by one of said sections, one end of said striker supporting said bar and the other end of which is adapted to engage a strike plate affixed to the other of said sections not supporting said striker at the end opposite said pivot point, said striker being adapted to place said bar in a position close to said first row of tines with said second row of tines in position to pierce said drupe impaled on said first row of tines with said stone thereof approximately centered in said free space, and said striker forcing said right and left sections to pivot apart at said pivot point by engaging said strike plate when said bar is moved into said position close to said first row of tines and tearing apart said drupe so impaled on said first row of tines.

3. The apparatus of claim 2 wherein said right and left sections are biased to return to the closed position when the force effecting opening of the same is removed.

* * * * *